US006053427A

United States Patent [19]

Wilger et al.

[11] Patent Number: 6,053,427

[45] Date of Patent: Apr. 25, 2000

[54] SPRAYER NOZZLE FLUID SUPPLY SYSTEM

[76] Inventors: Wilfred H. Wilger, 219 Ball Crescent, Saskatoon, Saskatchewan, Canada, S7K 6E1; Mark Bartel, 120 Lakewood Dr., Lexington, Tenn. 38351

[21] Appl. No.: 09/123,931

[22] Filed: Jul. 28, 1998

[51] Int. Cl.[7] ..... B05B 1/20

[52] U.S. Cl. ..... 239/159; 239/267; 239/726; 285/305

[58] Field of Search ..... 239/159, 163, 239/171, 172, 266, 267, 268, 722, 726, 727, 728, 734; 285/305, 133.21, 133.3

[56] References Cited

U.S. PATENT DOCUMENTS 2,793,909 5/1957 Gerbracht ..... 239/268 X
4,735,365 4/1988 Smeller et al. ..... 285/305 X
4,949,656 8/1990 Lyle et al. ..... 239/727 X
5,516,044 5/1996 Thorstensson ..... 239/159

*Primary Examiner*—Lesley D. Morris
*Attorney, Agent, or Firm*—Adams Law Firm, P.A.

[57] ABSTRACT

A nozzle fluid supply system for use in sprayers that combines the modular advantages of a dry boom system with the high capacity of a wet boom system. Pressurized fluid is carried by rigid tubes connecting adjacent nozzle holding members attached to the sprayer. A two-part nozzle holding member is disclosed for attachment to a dry boom bracket through a hole therein. The combination of the short rigid tubes and two-part nozzle holding member provide a modular system with interchangeable parts.

24 Claims, 6 Drawing Sheets

SPRAYER NOZZLE FLUID SUPPLY SYSTEM

BACKGROUND

Sprayers are commonly used in agriculture, horticulture and such things as golf course maintenance where chemicals are mixed with water and then sprayed on the ground or on growing crops. Sprayers can be mounted on or towed by a vehicle on the ground or aerial, carried by airplanes or helicopters.

Sprayers commonly comprise a tank of fluid, a pump for pressurizing and distributing the fluid through pipes or hoses to spray nozzles, and means to control the fluid pressure. They typically have a plurality of nozzle bodies, each securing a spray nozzle, spaced apart on a boom, perpendicular to the direction of travel, at a standard spacing distance which corresponds to the spray pattern of the nozzles. The booms typically swing in for transport and out for operation. Sprayers mounted on airplanes have booms secured to the wings.

The booms may be of the "wet boom" type, where the boom comprises a frame member with a pipe mounted thereon, the fluid passing through the pipe into nozzles mounted on the pipe and fluidly connected thereto, or a "dry boom" type, where the nozzles are mounted to the frame member and fluid passes to the nozzles through a hose which is connected between the nozzles.

The dry boom system has the advantage of being modular, and therefore very flexible. Various nozzle bodies can be mounted directly to a frame by whatever method that is convenient. Flexible hoses are then used to supply pressurized fluid to the nozzle bodies, typically by connection with hose clamps from one nozzle holding member to the next.

The wet boom does not have this flexibility. Different lengths of pipe are required on a sprayer, and damage to one part of a pipe requires replacement of the whole pipe. As the nozzle holding member must be mounted on the pipe, mounting methods are more limited.

One of the present problems with the dry boom system is that with today's wider and faster sprayers, much greater volumes of fluid must flow through the hoses. Hoses with sufficient diameter to accommodate theses flows and contain the required pressures are expensive. For this reason, in today's larger sprayers, the "wet boom" system is most often used.

The present common nozzle holding member design allows for connection of the pressurized fluid supply at one end, a check valve to prevent dripping in the middle, and attachment of a screen and nozzle at the opposite end.

The attachment of the nozzle holding member to the boom is a time consuming operation, both for the dealer or manufacturer at the set-up stage before delivery, and for the operator when doing repairs or maintenance. Repairs by the operator should be done wearing rubber gloves to protect from contact with chemicals being used, however removing present nozzle bodies is difficult when so encumbered and so operators often do not use gloves. Operator repairs are often required, such as when a nozzle strikes an obstacle in the field and breaks off.

In the dry boom system, the nozzle holding member typically has two hose barbs, with the hose joining each nozzle holding member, the nozzle holding member thereby becoming a part of the conduit carrying fluid to the next nozzle holding member. These systems use a two part clamp to secure the nozzle holding member whereby the first part of the clamp is fixed to the boom, recesses on the nozzle holding member are engaged with the first part of the clamp, and the second part of the clamp is placed around the nozzle holding member and fastened to the first part of the clamp with bolts, screws or the like.

SUMMARY OF THE INVENTION

It is an object of the present invention to provide a nozzle fluid supply system for use in sprayers that has a high capacity, is inexpensive and may be quickly attached to and removed from a nozzle holding member.

It is a further object of the present invention to provide a nozzle holding member for ground sprayers which may be quickly attached to and removed from a sprayer boom.

It is a further object of the present invention to provide a modular sprayer nozzle fluid supply system wherein parts are largely interchangeable.

The invention accomplishes these objects providing a nozzle fluid supply system for use in sprayers comprising a plurality of nozzle holding members mountable on a sprayer, said nozzle holding members each including connection means for connecting said nozzle holding members to a pressurized fluid supply; a first rigid tube having a first end operatively connected to the pressurized fluid supply of a first nozzle holding member, and a second end operatively connected to said connection means of an adjacent second nozzle holding member; wherein pressurized fluid passes through said first rigid tube from said first nozzle holding member to supply pressurized fluid to said second nozzle holding member.

The rigid tube may have some resiliency, as it is likely made of a plastic material and will flex somewhat. The rigidity refers to the fact that the tube is not flexible and will resist crushing and bending.

The connection means for connecting the pressurized fluid supply on the first nozzle holding member could comprise a T fluid conduit, an input leg of the T fluid conduit connected to a pressurized fluid supply, a supply leg connected to supply the nozzle secured in said first nozzle holding member and an output leg connected to said first end of said rigid tube.

A similar T fluid conduit could be the connection means for the pressurized fluid supply of the second nozzle holding member, an input leg of the T fluid conduit connected to the second end of said rigid tube, a supply leg connected to supply the nozzle secured in said second nozzle holding member and an output leg connected to a second rigid tube. The rigid tube then becomes the pressurized fluid supply for the second nozzle holding member, and the second rigid tube could be used to supply a third nozzle holding member, and so forth.

The rigid tube could be operatively connected by sliding the tube along its longitudinal axis into engagement with the leg of the T fluid conduit. The rigid tube could fit inside the leg of the T fluid conduit or vice versa. An O-ring could be held in place by a recess defined in one of said rigid tube or said T fluid conduit, and be in sealing contact with said T fluid conduit and said rigid tube when same are engaged.

There could be included means to fasten the T fluid conduit to said tube, which means could comprise a clip engaging recesses in the connected conduit and tube.

Alternatively the rigid tube could be connected to said T fluid conduits using pipe unions.

The invention also provides a nozzle mounting system for use in sprayers comprising a two part nozzle holding member comprising a first part and a second part, said nozzle holding member adapted to connect to a pressurized fluid supply and to convey said pressurized fluid to a nozzle secured in its operating position by said nozzle holding member; a bracket fixed to a sprayer boom, said bracket defining a hole therein; a projecting portion of said first part of said nozzle holding member fitting inside and projecting through said hole wherein said hole and said projecting portion are shaped to retard rotation of said first part of said nozzle holding member; and said second part of said nozzle holding member is adapted to engage said first portion such that said bracket is between said first part and said second part when said second part is thus engaged.

The hole and projecting portion could be rectangular, which shape would effectively prevent the nozzle holding member from rotating and hold it in its proper operating position.

The connection of the pressurized fluid supply to the nozzle holding member could be by connection to one part, with the nozzle secured in the other said part. A liquid seal would then be required in the joint between the parts. Alternatively, the connection of the pressurized fluid supply could be to the same part of the nozzle holding member as that securing the nozzle, the remaining part acting only to secure the nozzle holding member to the bracket.

The engagement of the first and second parts of the nozzle holding member could be by laterally sliding the projections on one said part into recesses defined by the other said part. In the cases where a liquid seal between parts is required, an O-ring could be secured in a recess in one part and provide a seal against the other part when the parts are engaged, the pressurized fluid flowing through the centre of the O-ring.

Alternatively the engagement of the first and second parts of the nozzle holding member could be by mating screw threads in each said part or by use of a quarter turn bayonet connection. A conventional liquid seal could easily be provided for such an engagement.

Combining the nozzle mounting system and fluid supply system described above would provide a modular sprayer nozzle fluid supply system for a sprayer. Large diameter pipes or tubes may be used in short, standard length sections, these tubes being held in place between the nozzle bodies fixed to the boom, with O-ring seals or the like providing the fluid seal. Thus the invention allows for retention of the modular advantages of the dry boom system while having the increased capacity of the wet boom system.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE EMBODIMENT

Figure 1:
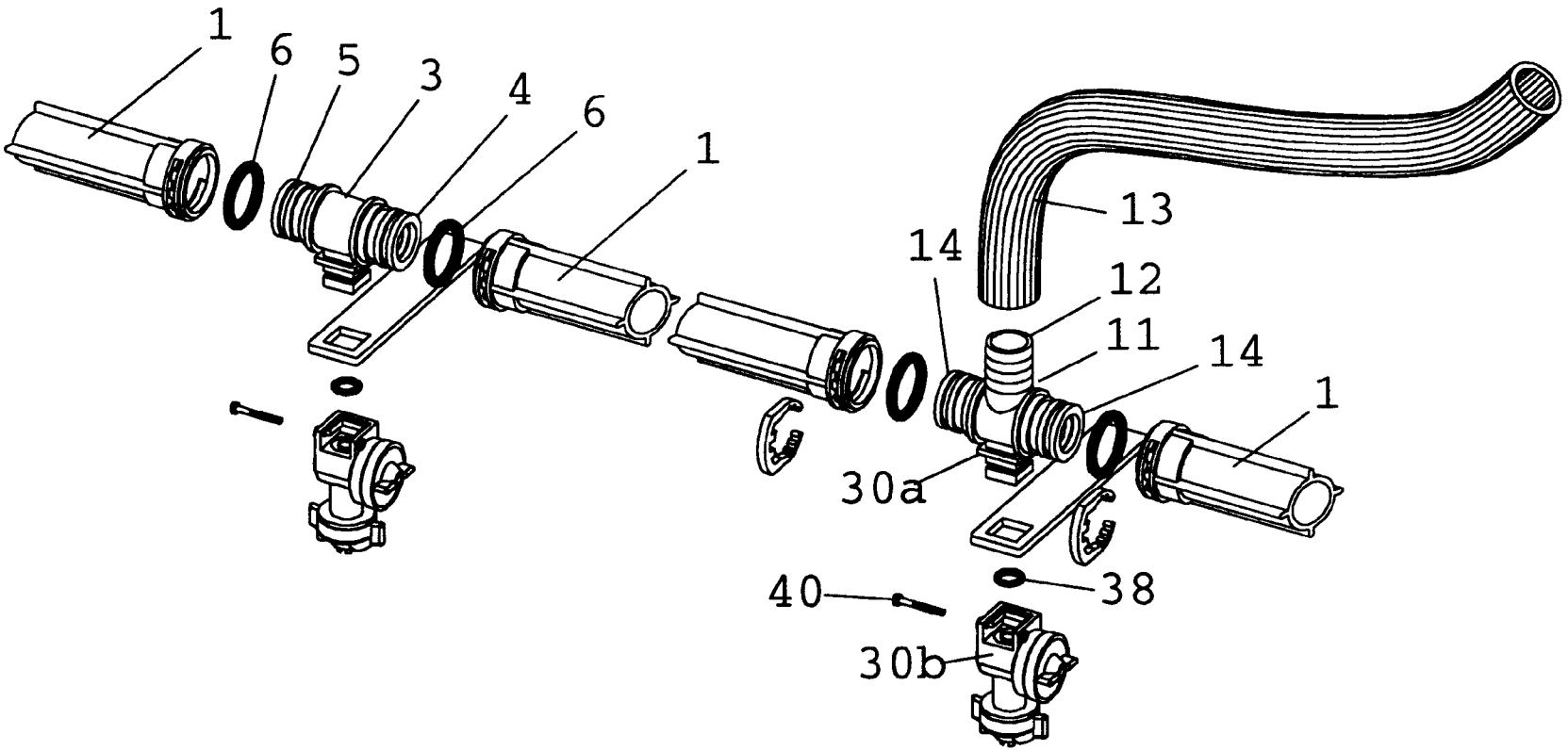
FIG. 1 is an exploded perspective view of the embodiment.
Figure 2:
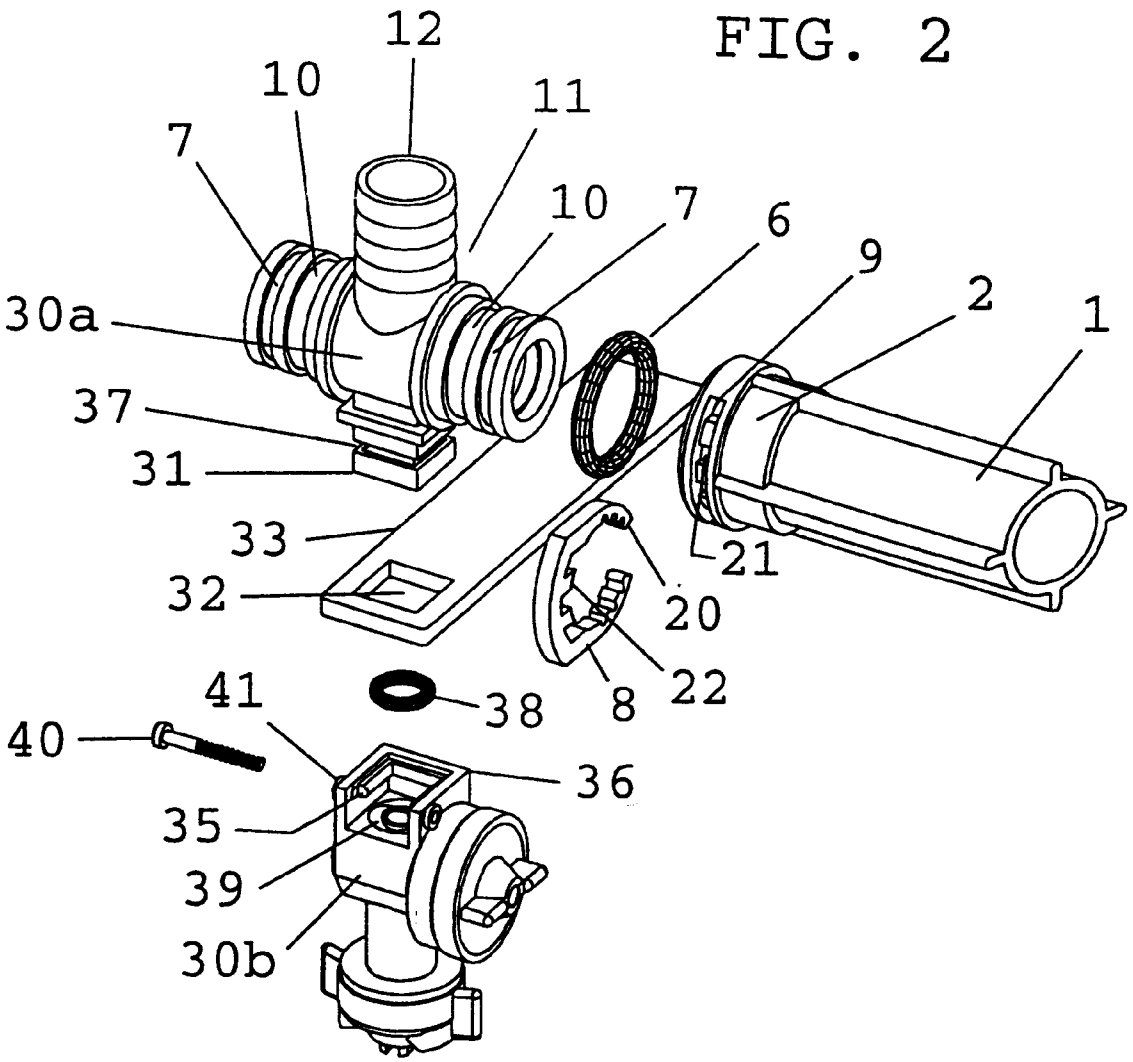
FIG. 2 is a perspective detail view of the two part nozzle holding member and of the attachment of the rigid tube thereto.
Figure 7:
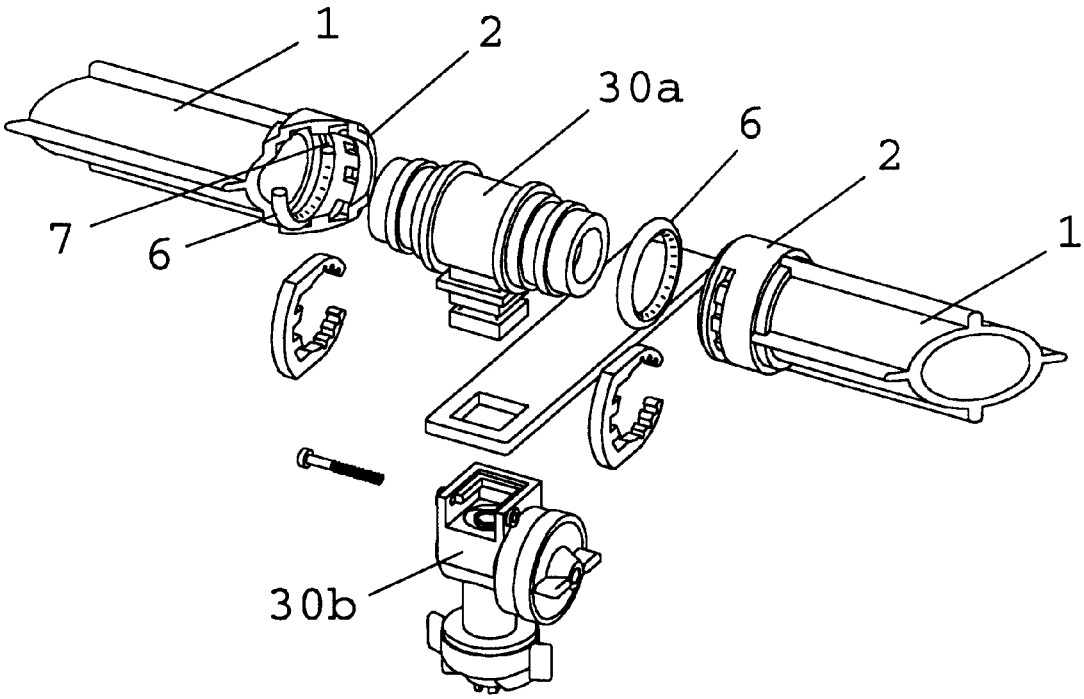
FIG. 7 is a perspective view of an alternate embodiment where an O-ring recess is defined in the rigid tube.

In one embodiment, shown in FIGS. 1 and 2, rigid tube 1 is a plastic tube formed at each end into a female receptacle 2 accepting the input leg 4 or output leg 5 of the in-line T fluid conduit 3 in an operative connection. A fluid seal of this connection is formed by O-ring 6 disposed in an O-ring groove 7 in the input or output legs 4,5 and acting against the inside surface of the female receptacle 2. FIG. 7 shows an alternate configuration where the O-ring 6 is disposed in an O-ring groove 7 in the female receptacle 2.

Figure 4:
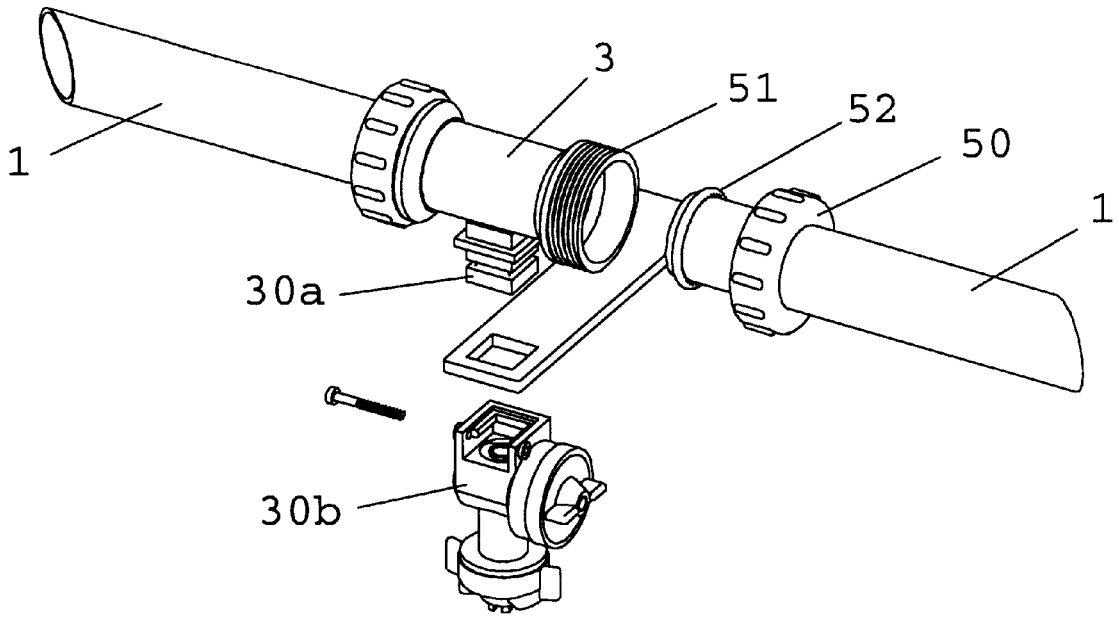
FIG. 4 is a perspective view of an alternate embodiment where the rigid tube is connected to the T fluid conduits with pipe unions.

The connection is held together by retainer clip 8 inserted in a clip slot 9 in each end of the rigid tube 1. The retainer clip 8 extends through the clip slot 9 to engage the clip groove 10 in the in-line T fluid conduit 3. The connection is strengthened by clip teeth 22 engaging in slot recesses 21. The clip 8 is resilient and clip arms 20 flex when inserted and wrap around the clip groove 10. There is a tolerance built into the connection to allow for slight movements of the rigid tube 1 along its axis in the field. FIG. 4 shows an alternate embodiment wherein the rigid tube 1 is attached to the in-line T fluid conduit 3 by a pipe union comprising threaded male and female union parts 51 and 50, and seal 52.

Figure 8:
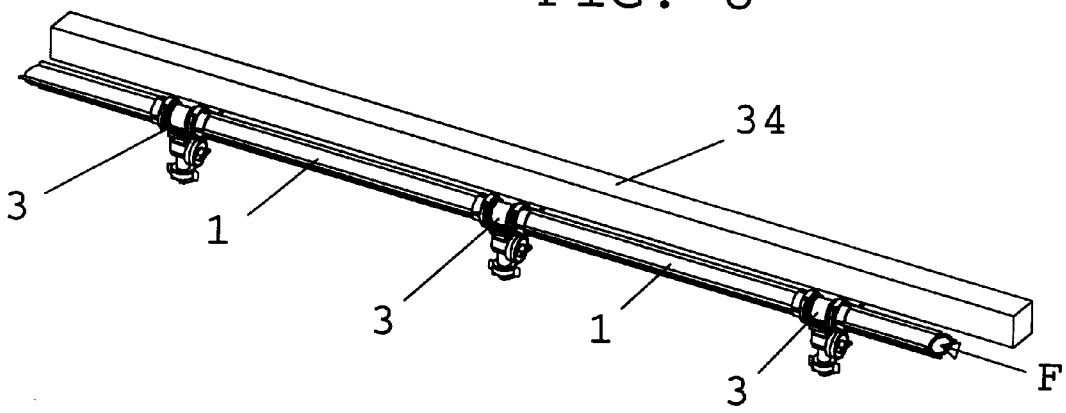
FIG. 8 is a perspective view illustrating a series of in-line T fluid conduits and rigid tubes.

FIG. 8 illustrates how the in-line T fluid conduits 3 and rigid tubes 1 are mounted in series along the dry sprayer boom 34, with pressurized fluid entering the system at F.

Also illustrated is a supply T fluid conduit 11 which is identical to the in-line T conduit 3 with the addition of a hose barb connector 12 allowing for connection of a pressurized fluid supply 13 to the system. In this configuration fluid flows out both legs 14 of the supply T fluid conduit 11 to feed the rigid tubes 1 and in-line T fluid conduits 3 downstream.

Figure 3:
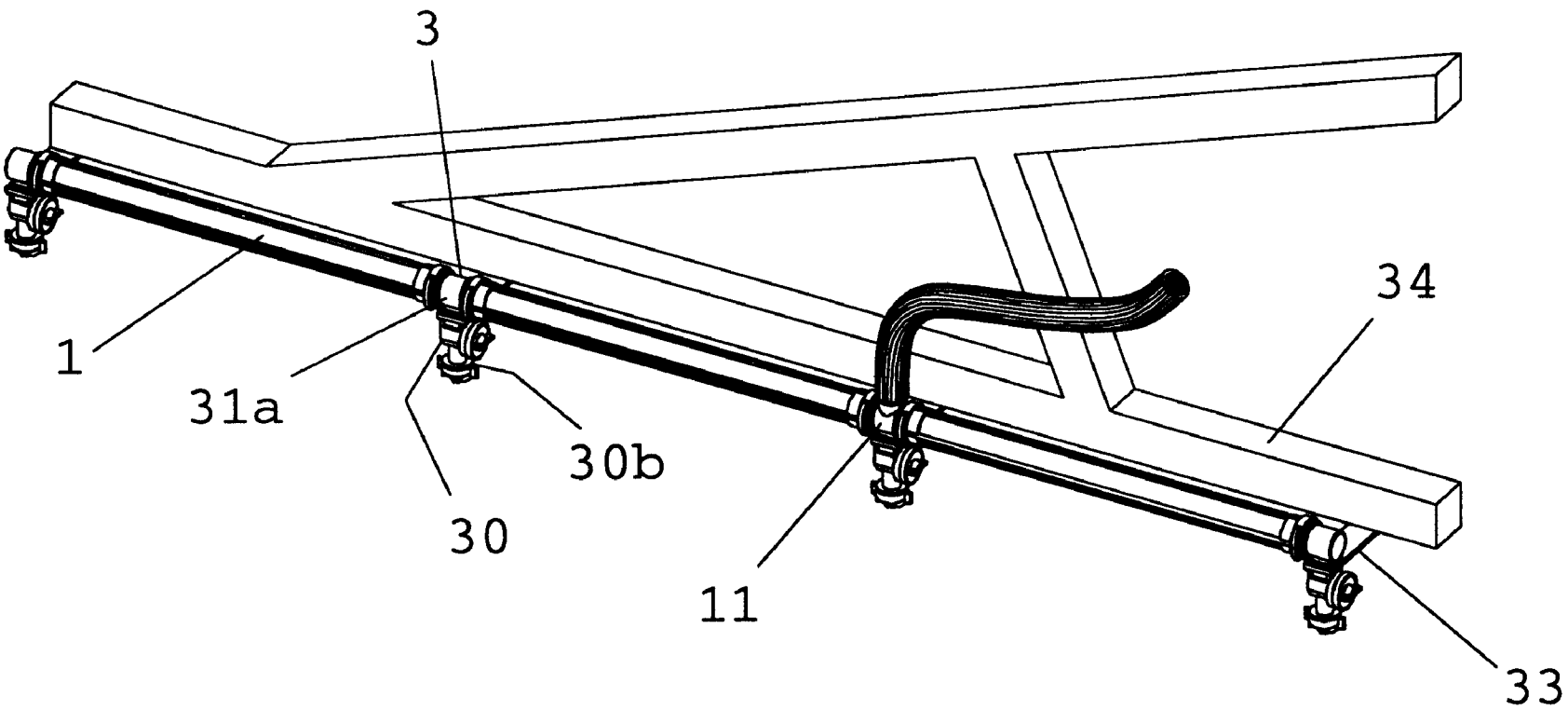
FIG. 3 is a perspective view of the embodiment of FIG. 1 mounted on a sprayer boom.

The supply and in-line T fluid conduits 3,11 also serve as the upper part 30*a* of the two part nozzle holding member 30. Square extension 31 extends from the bottom of supply and in-line T fluid conduits 3,11 through clamp hole 32 in bracket 33. Bracket 33 is fixed to the dry sprayer boom 34, thereby attaching the system to the sprayer. FIG. 3 illustrates the system in place on a sprayer boom.

Lower part 30*b* of nozzle holding member 30 connects to upper part 30*a* by sliding the projections 35 on the socket 36 of the lower part 30*b* into engagement with the mating grooves 37 on the square extension 31. A fluid seal of the connection is provided by an O-ring 38 disposed in O-ring groove 39 in the socket 36. The parts are oriented such that when the parts are connected, some pressure is exerted on the bracket 33 between the two parts 30*a* and 30*b*, thereby holding the nozzle holding member 30 solidly to the bracket. The connection is secured by screw 40 through holes 41 in the lower part 30*b*.

Figure 5:
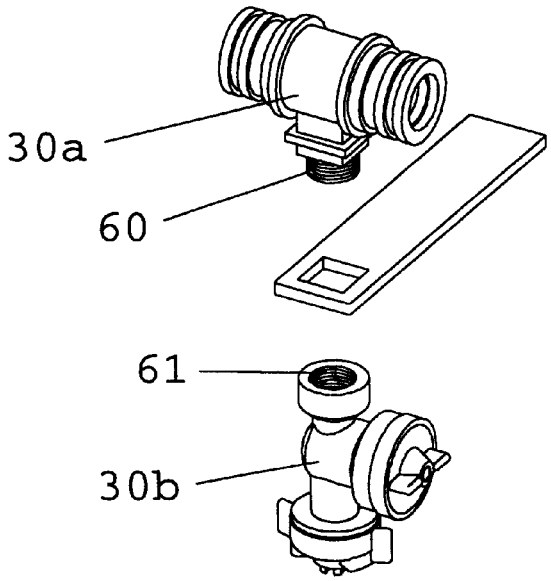
FIG. 5 is a perspective view of an alternate embodiment where the engagement of the first and second parts of the nozzle holding member is by mating screw threads in each part.
Figure 6:
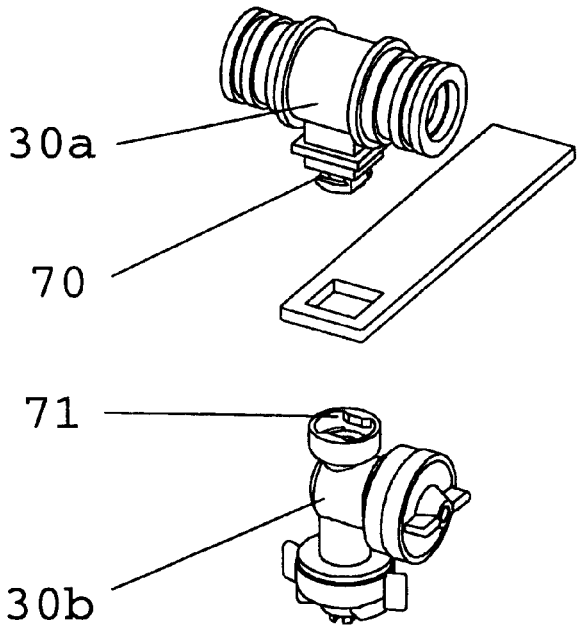
FIG. 6 is a perspective view of an alternate embodiment where the engagement of the first and second parts of the nozzle holding member is by use of a quarter turn bayonet connection.

It is contemplated that the connection of the upper and lower parts 30*a* and 30*b* could also be by a screw connection as illustrated in FIG. 5 with threaded male and female parts 60, 61, a quarter turn bayonet connection as illustrated in FIG. 6 with male and female parts 70, 71 or any similar method and such variations are considered to fall within the scope of the enclosed invention.

Figure 9:
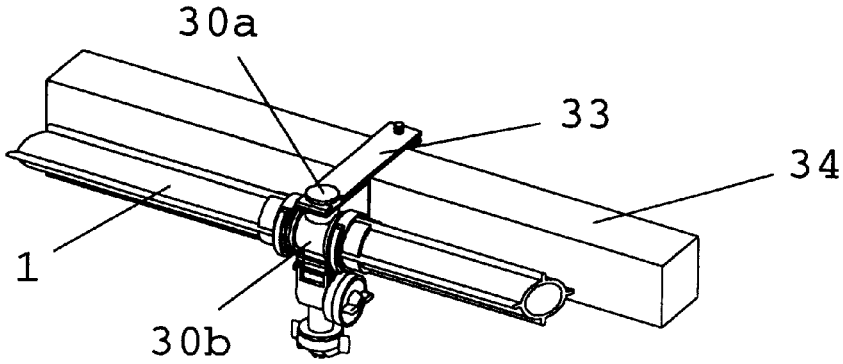
FIG. 9 is a perspective view of an alternate embodiment where the nozzle is secured to the same part of the holding member which is in connection with the pressurized fluid supply.

In the described embodiment the fluid is supplied to the upper part 30*a*, while the nozzle and drip diaphragm are located in the lower part 30*b*. As illustrated in FIG. 9, the fluid supply, drip diaphragm and nozzle could all be located in one part, 30*b* and the other part, 30*a* could serve only to clamp the nozzle holding member 30 to the bracket 33. Other configurations are possible as well. Similarly the mounting means could be on the side of the nozzle holding member 30.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

We claim:

1. A nozzle fluid supply system for use in sprayers comprising:

a plurality of nozzle holding members mountable on a sprayer, said nozzle holding members each including connection means for connecting said nozzle holding members to a pressurized fluid supply;

a first rigid tube having a first end operatively connected to the pressurized fluid supply of a first nozzle holding member, and a second end operatively connected to said connection means of an adjacent second nozzle holding member;

wherein pressurized fluid passes through said first rigid tube from said first nozzle holding member to supply pressurized fluid to said second nozzle holding member.

2. The invention of claim 1 wherein said connection means on said first nozzle holding member comprises a first T fluid conduit, an input leg of said first T fluid conduit connected to said pressurized fluid supply, a supply leg connected to supply a nozzle secured in said first nozzle holding member and an output leg connected to said first end of said first rigid tube.

3. The invention of claim 2 wherein said connection means on said second nozzle holding member comprises a second T fluid conduit, an input leg of said second T fluid conduit connected to said second end of said first rigid tube, a supply leg connected to supply a nozzle secured in said second nozzle holding member and an output leg connected to a second rigid tube.

4. The invention of claim 3 wherein said first rigid tube is operatively connected by sliding same along its longitudinal axis into engagement with said legs of said T fluid conduits.

5. The invention of claim 4 wherein said operative connection of said first rigid tube to one said T fluid conduit comprises an O-ring held in place by a recess defined in one of said first rigid tube or said T fluid conduit, and which O-ring is in sealing contact with said T fluid conduit and said first rigid tube when same are engaged.

6. The invention of claim 5 further comprising means to fasten said T fluid conduit to said first rigid tube.

7. The invention of claim 6 wherein said means to fasten said T fluid conduit to said first rigid tube comprises a clip engaging recesses in said T fluid conduit.

8. The invention of claim 3 wherein said first rigid tube is connected to one said T fluid conduit using pipe unions.

9. A nozzle mounting system for use in sprayers comprising:

a two part nozzle holding member comprising a first part and a second part, said nozzle holding member adapted to connect to a pressurized fluid supply and to convey said pressurized fluid to a nozzle secured in its operating position by said nozzle holding member;

a bracket fixed to a sprayer boom, said bracket defining a hole therein;

a projecting portion of said first part of said nozzle holding member fitting inside and projecting through said hole wherein said hole and said projecting portion are shaped to retard rotation of said first part of said nozzle holding member; and said second part of said nozzle holding member is adapted to engage said projecting portion such that said bracket is between said first part and said second part when said second part is thus engaged.

10. The invention of claim 9 wherein said hole and said projecting portion are rectangular.

11. The invention of claim 9 wherein the connection of said pressurized fluid supply to said nozzle holding member is by connection to one of said parts, and said nozzle is secured in the other said part.

12. The invention of claim 11 further comprising a fluid seal between said first and second parts of said nozzle holding member.

13. The invention of claim 9 wherein the connection of said pressurized fluid supply to said nozzle holding member is by connection to one of said parts, and said nozzle is secured in the same said part, said remaining part acting only to secure said nozzle holding member to said bracket.

14. The invention of claim 9 wherein the engagement of said first and second parts of said nozzle holding member is by laterally sliding projections on one said part into recesses defined by the other said part.

15. The invention of claim 14 further comprising a resilient seal, said seal secured in a recess in one said part and providing a seal against the other said part when the parts are engaged, wherein said pressurized fluid flows through the center of said seal.

16. The invention of claim 9 wherein the engagement of said first and second parts of said nozzle holding member is by mating screw threads in each said part.

17. The invention of claim 9 wherein the engagement of said first and second parts of said nozzle holding member is by use of a quarter turn bayonet connection.

18. A modular sprayer nozzle fluid supply system for use in sprayers comprising:

a nozzle mounting system according to claim 9, a first rigid tube having a first end operatively connected to the pressurized fluid supply of a first nozzle holding member, and a second end operatively connected to the pressurized fluid supply of an adjacent second nozzle holding member;

wherein pressurized fluid passes through said first rigid tube from said first nozzle holding member to supply pressurized fluid to said second nozzle holding member.

19. The invention of claim 9 wherein the connection on said first nozzle holding member comprises a T fluid conduit, an input leg of said T fluid conduit connected to said pressurized fluid supply, a supply leg connected to supply the nozzle secured in said first nozzle holding member and an output leg connected to said first end of said rigid tube.

20. The invention of claim 19 wherein the connection on said second nozzle holding member comprises a T fluid conduit, an input leg of said T fluid conduit connected to said second end of said rigid tube, a supply leg connected to supply the nozzle secured in said second nozzle holding member and an output leg connected to a second rigid tube.

21. The invention of claim 20 wherein said rigid tube is operatively connected by sliding the tube along its longitudinal axis into engagement with said legs of said T fluid conduits.

22. The invention of claim 21 wherein said operative connection of said rigid tube to said T fluid conduits comprises an O-ring held in place by a recess defined in one of said rigid tube or said T fluid conduits, and which O-ring is in sealing contact with one of said T fluid conduits and said rigid tube when same are engaged.

23. The invention of claim 22 further comprising means to fasten one of said T fluid conduits to said first rigid tube.

24. The invention of claim 23 wherein means to fasten one of said T fluid conduits to said first rigid tube comprises a clip engaging recesses in said T fluid conduit.

* * * * *